United States Patent [19]

Arakawa

[11] Patent Number: 5,061,157

[45] Date of Patent: Oct. 29, 1991

[54] SUBMERSIBLE PUMP

[75] Inventor: Shinichiro Arakawa, Kanagawa, Japan

[73] Assignee: Ebara Corporation, Tokyo, Japan

[21] Appl. No.: 584,951

[22] Filed: Sep. 18, 1990

[30] Foreign Application Priority Data

Sep. 26, 1989 [JP] Japan ..... 1-249861
Jul. 23, 1990 [JP] Japan ..... 2-195775

[51] Int. Cl.[5] ..... F04B 35/04

[52] U.S. Cl. ..... 417/423.14; 417/423.3; 417/423.9; 417/424.1

[58] Field of Search ..... 417/423.1, 423.3, 423.11, 417/423.14, 423.15, 424.1, 423.9; 415/121.2

[56] References Cited

U.S. PATENT DOCUMENTS 2,969,740 1/1961 Kaatz ..... 417/423.3
4,549,849 10/1985 Jensen et al. ..... 415/213.1

FOREIGN PATENT DOCUMENTS 3609311 10/1987 Fed. Rep. of Germany .
2563060 10/1985 France .
57-59758 12/1982 Japan .
58-30160 7/1983 Japan .

OTHER PUBLICATIONS

Patent Abstract of Japan, vol. 12, No. 145, (M-693) [2992], May 6, 1988 of Japanese Patent Appln. No. 62-265493, Nov. 18, 1987.

*Primary Examiner*—Leonard E. Smith
*Assistant Examiner*—Charles G. Freay
*Attorney, Agent, or Firm*—Armstrong, Nikaido, Marmelstein, Kubovcik & Murray

[57] ABSTRACT

A submersible pump comprising: a discharge casing open at the bottom thereof; a motor case fixed inside the discharge casing and containing therein a motor for driving an impeller; a support plate positioned so as to close an opening of the discharge casing for supporting the motor case; a downwardly concaved pump casing placed under the support plate for defining a pressure chamber between it and the support plate; and a downwardly concaved strainer placed under the pump casing for defining a suction chamber between it and the pump casing is disclosed. In this submersible pump, the discharge casing has an increased-diameter stepped flange integrally formed along the periphery of the opening of the discharge casing. Within a stepped portion of the stepped flange there are sequentially mounted respective peripheral portions of the support plate, of the pump casing, and of the strainer. The discharge casing and the support plate are fastened together by first bolts vertically extending therethrough, and in that the support plate, the pump casing and the strainer are fastened together by second bolts vertically extending therethrough. By this arrangement, the entire pump can be easily assembled by fastening the first and second bolts.

11 Claims, 6 Drawing Sheets

SUBMERSIBLE PUMP

BACKGROUND OF THE INVENTION

1. Field of the Invention

The present invention relates to a submersible pump, and particularly to a submersible pump which has a particularly simple structure and may be readily assembled.

2. Prior Art

Generally, a submersible pump is known which comprises: a discharge casing open at the bottom thereof; a motor case fixed inside the discharge casing and containing therein a motor for driving an impeller; a support plate positioned so as to close an opening of said discharge casing for supporting said motor case; a downwardly concaved pump casing placed under the support plate for defining a volute chamber between it and the support plate; and a downwardly concaved strainer placed under the pump casing for defining a suction chamber between it and the pump casing.

Conventional submersible pumps of this type are assembled by laying the discharge casing, motor case support plate, pump casing and strainer on one another, and securing them together at their superposed portions by means of bolts.

However, conventional pumps, which are assembled by bolting the superposed portions of the individual members, present problems in that they are not easy to assemble or handle.

Namely, in assembling such conventional pumps, at least the respective superposed portions between the discharge casing and the motor case, between the motor case and the support plate, between the discharge casing and the support plate, and between the support plate and the strainer must be secured by means of bolts. In this case, the pump casing is bolted together with the discharge casing and the support plate or with the support plate and the strainer. Therefore, many superposed portions must be secured by means of different kinds of bolts. Also, since many bolt holes must be aligned together in assemblage, not only is alignment of these bolt holes required, but also these bolt holes must be machined to a high degree of accuracy.

SUMMARY OF THE INVENTION

An object of the present invention is, therefore, to overcome the above-mentioned problems associated with the prior art by providing a submersible pump which has of a particularly simple structure and may be readily assembled.

In order to achieve the above-mentioned object, a submersible pump according to one aspect of the present invention comprises: a discharge casing open at the bottom thereof; a motor case fixed inside the discharge casing and containing therein a motor for driving an impeller; a support plate positioned so as to close an opening of said discharge casing for supporting said motor case; a downwardly concaved pump casing placed under the support plate for defining a volute chamber between it and the support plate; and a downwardly concaved strainer placed under the pump casing for defining a suction chamber between it and the pump casing. In this submersible pump, said discharge casing has a stepped flange of increased-diameter which is integrally formed along the periphery of the lower end opening thereof. Within a stepped portion of the stepped flange, there are sequentially mounted respective peripheral portions of said support plate, of said pump casing, and of said strainer. Said discharge casing and said support plate are fastened together by first bolts vertically extending therethrough. Then, said support plate, said pump casing and said strainer are fastened together by second bolts vertically extending therethrough.

In accordance with another aspect of the present invention, a submersible pump which comprises: a discharge casing open at the bottom thereof; a motor case fixed inside the discharge casing and containing therein a motor for driving an impeller; a support plate positioned so as to close an opening of said discharge casing for supporting said motor case; a downwardly concaved pump casing placed under the support plate for defining a volute chamber between it and the support plate; and a downwardly concaved strainer placed under the pump casing for defining a suction chamber between it and the pump casing. In this submersible pump, said motor case has an outwardly extending connection flange formed integral therewith along the lowermost peripheral portion thereof. The connection flange and said support plate are fastened together by third bolts vertically extending therethrough. Said discharge casing has a stepped flange of an increased-diameter which is integrally formed along the periphery of a lower end opening thereof. A partition plate is secured to a stepped portion of the stepped flange. Under the partition plate secured to the stepped portion, there are sequentially mounted respective peripheral portions of said support plate, of said pump casing and of said strainer. Said partition plate, said support plate, said pump casing and said strainer are fastened together by fourth bolts vertically extending therethrough.

The pump according to the first aspect of the present invention may be simply assembled by sequentially mounting the respective peripheries of the support plate, pump casing and strainer within the stepped portion of the stepped flange formed along the periphery of the discharge casing opening, subsequently fastening the first bolts to secure the discharge casing and support plate together, followed by fastening the second bolts to secure the support plate, pump casing and strainer together. In this way, the alignment of the respective elements to be assembled is easily effected; the overall pump can thus be easily assembled by fastening the first and second bolts.

In accordance with the second aspect of the present invention, the third bolts are fastened to firstly assemble the motor case and the support plate for supporting the motor case, then securing the partition plate to the stepped portion of the stepped flange formed along the periphery of the discharge casing opening, sequentially placing the respective peripheries of the support plate, pump casing and strainer under the partition plate within the stepped portion, and finally, fastening the fourth bolts to assemble the partition plate, support plate, pump casing and strainer together. It is thus possible to reduce the length of the third bolts, and the shorter third bolts make the assembling process easier so that the entire pump can be assembled more easily.

The above and other objects, features and advantages of the present invention will become more apparent from the following description when taken in conjunction with the accompanying drawings in which a preferred embodiment of the present invention is shown by way of illustrative examples.

PREFERRED EMBODIMENTS OF THE INVENTION

Embodiments of the submersible pump according to the present invention will now be described with reference to the accompanying drawings.

Figure 1:
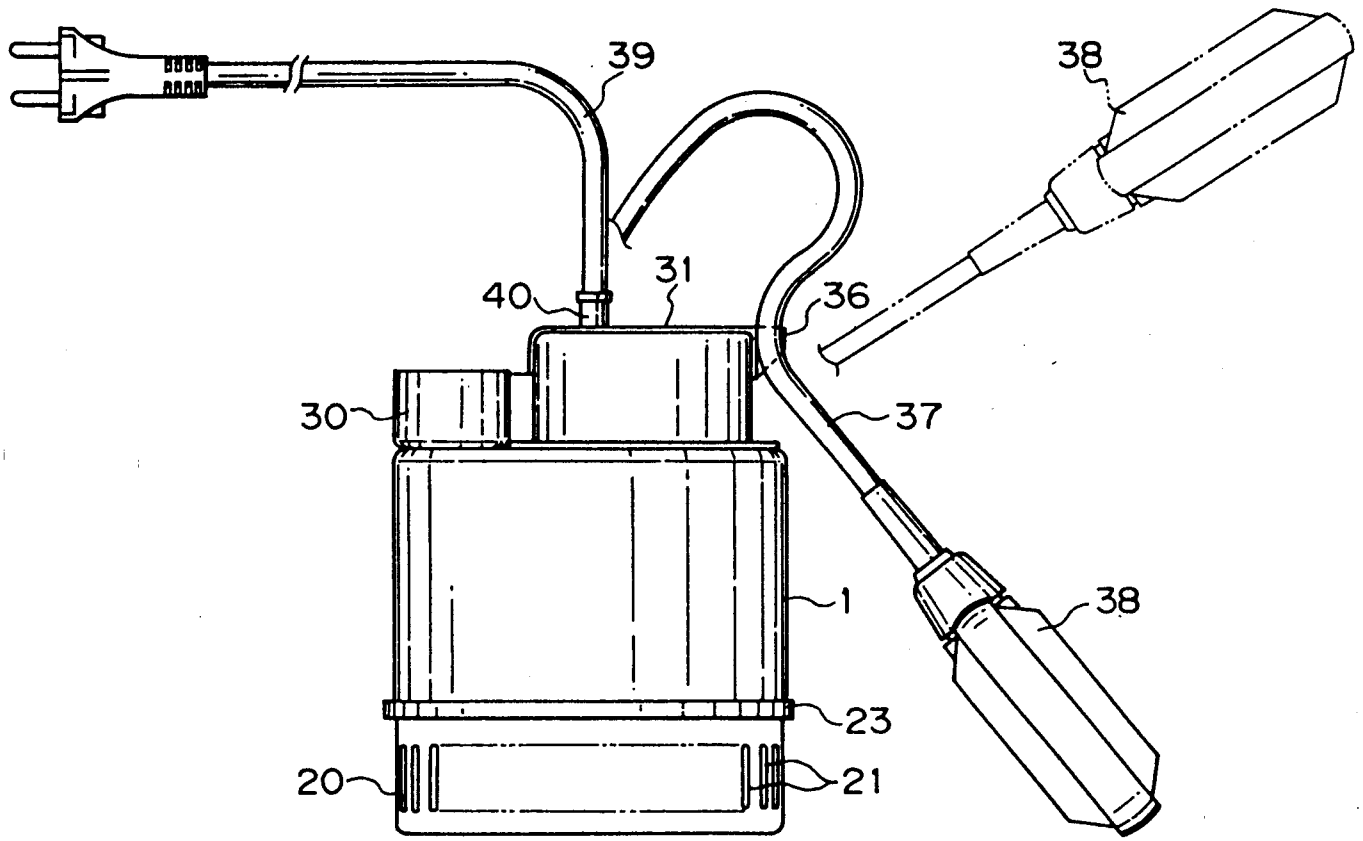
FIG. 1 is a side elevational view of an embodiment of the submersible pump according to the present invention.
Figure 2:
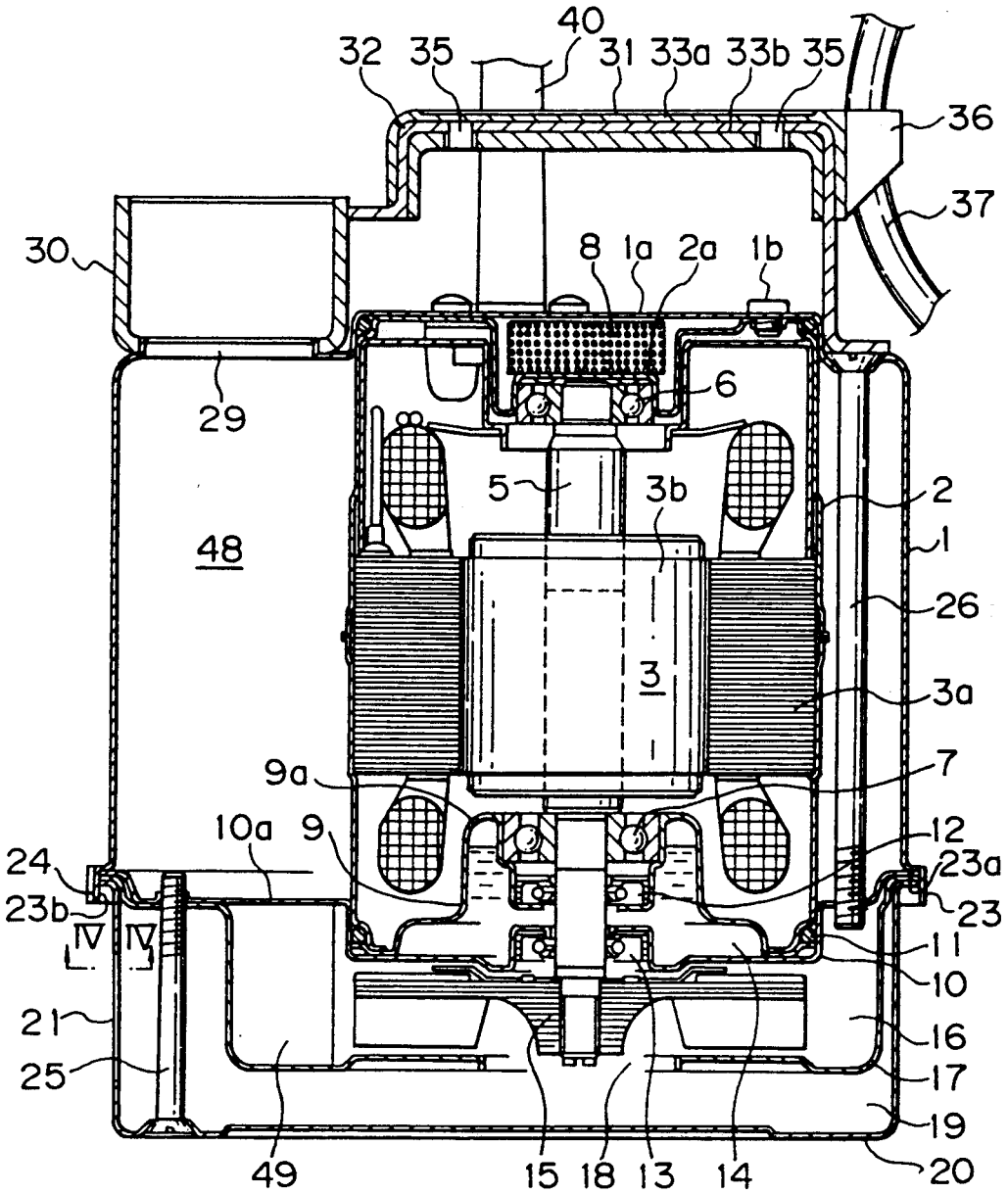
FIG. 2 is a longitudinal sectional view of the same.

In FIG. 1, reference numeral 1 designates a discharge casing which is formed by pressing and which is open at the bottom. Inside the discharge casing 1, a motor case 2 is fixed, as shown in FIG. 2, a stator 3*a* of a motor 3 being fixed to the inner surface of the motor case 2. The motor 3 has a rotor 3*b* which has an upright shaft 5 fixed thereto. The upright shaft 5 is rotatably supported by bearings 6 and 7 mounted on the top and bottom of the shaft 5.

The upper bearing 6 is supported inside a recess formed in a top plate 2*a* of the motor case 2. A case including drying agent 8 for removing moisture is interposed between the recessed portion of the top plate 2*a* and a top plate 1*a* of the discharge casing 1. The lower bearing 7 is supported inside a recess formed in a top plate 9*a* of a bearing supporting plate 9. This bearing supporting plate 9 is sandwiched between the lower end of said motor case 2 and a support plate 10 which supports the motor case 2. Reference numeral 11 designates an O-ring sealing between the motor case 2 and the bearing support plate 9, and 12 and 13 designate oil seals. The upper oil seal 12 is supported in the recess formed in the bearing supporting plate 9, while the lower oil seal 13 is supported in a recess formed in the support plate 10. Oil 14 charged between the bearing supporting plate 9 and the support plate 10 is sealed by these oil seals 12 and 13.

The upright shaft 5 extends downwardly through and beyond the support plate 10, an impeller 15 being secured to the lower end of the upright shaft 5. The impeller 15 is surrounded by a downwardly concaved pump casing 17 which defines a volute-shaped pressure chamber 16 between it and the support plate 10. The pump casing 17 has a bottom plate which is provided with a suction port 18 opening at the center thereof. A downwardly concaved strainer 20 defining a suction chamber 19 therein is provided outside the pump casing 17. The strainer 20 has a plurality of circumferentially equally spaced apart and vertically extending slits 21, 21, . . . formed in the wall thereof.

The discharge casing 1 has an increased-diameter stepped flange 23 formed integral therewith along the circumference of the lower end opening thereof. Within a stepped portion 23*a* of the stepped flange 23, the peripheral portions of the above-mentioned support plate 10, the pump casing 17 and the strainer 20 are sequentially mounted. The support plate 10, the pump casing 17 and the strainer 20 are fastened together by means of a plurality of second bolts 25, 25, . . . , 25 vertically extending therethrough, while the discharge casing 1 and the support plate 10 are fastened together by means of a plurality of first bolts 26, 26, . . . , 26 vertically extending therethrough.

In accordance with this embodiment, the first bolts 26 are firstly fastened and the second bolts 25 are subsequently fastened to assemble the support plate 10, the pump casing 17 and the strainer 20 together. Thus, the entire pump can be easily assembled. Further, when the flange 23 has radially inwardly extending projections 23*b* formed on the inner surface thereof and the support plate 10, the pump casing 17 and the strainer 20 have corresponding grooves 24 formed in their respective peripheral portions for receiving the projections 23*b* therein, the entire pump may be further easily assembled by engaging the projections 23*b* and the corresponding receiving groves 24 together to easily position the members 1, 10, 17 and 20 (see FIG. 4*b*).

Figure 3:
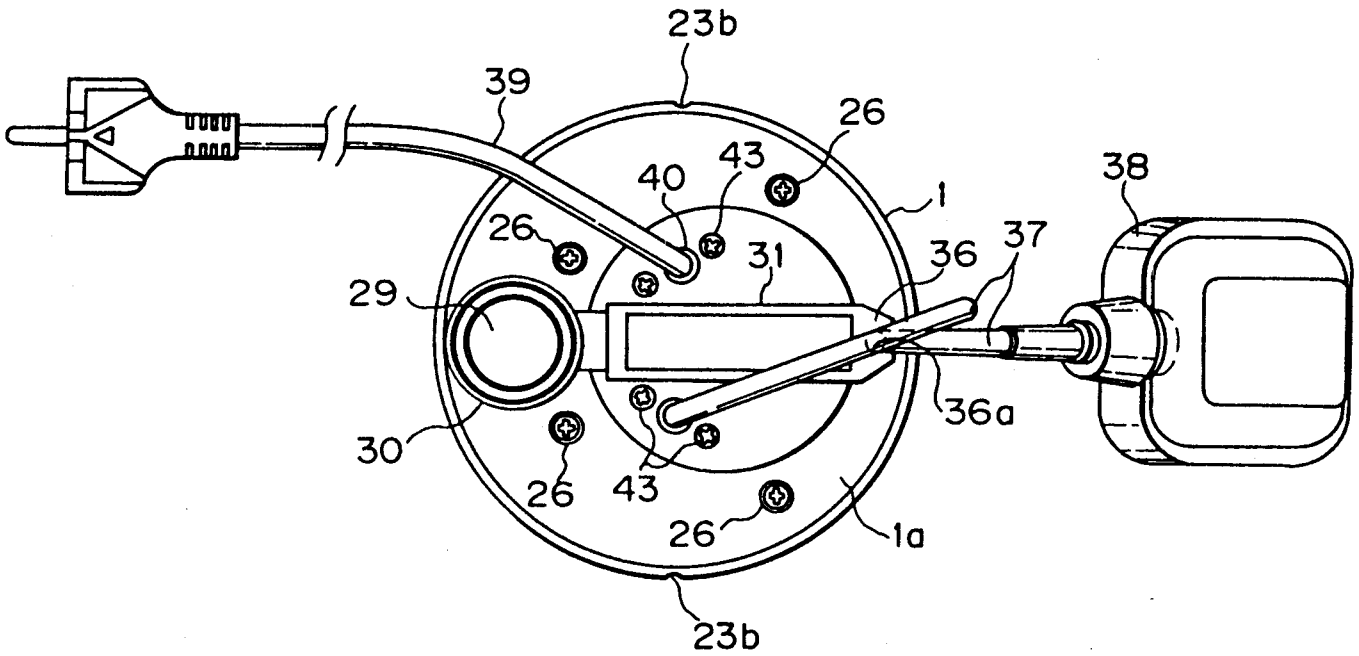
FIG. 3 is a plan view of the same.

The top plate 1*a* of the discharge casing 1 has a discharge mouth 29 to which a discharge pipe 30 is connected, as shown in FIGS. 2 and 3. A handle 31 is connected between the discharge pipe 30 and the above-mentioned top plate 1*a*. The handle 31 has a structure in which a steel base member 32 is sandwiched between top and bottom plastics covers 33*a* and 33*b*, respectively, which are fastened together by screws 35.

The top cover 33*a* has a cord supporting section 36 provided at an end thereof, which cord supporting section 36 has a catch groove 36*a* formed therein, as clearly shown in FIG. 3. A flexible cord 37 is held fast in the catch groove 36*a*. This cord 37 has one end connected to the above-mentioned motor 3 and has the opposite end connected to a float switch 38. This float switch 38 comprises a mercury switch which is turned on to allow the motor 3 to be energized when the float switch 38 has been raised to a predetermined level, as shown by imaginary lines in FIG. 1, and is turned off when the float switch 38 lowers to a predetermined level, as shown by solid lines in the same figure. In FIG. 2, 1*b* is a terminal screw for connecting to an earth cable (not shown).

The operation of this pump is as follows: When the pump is placed under water, the above-mentioned float switch 38 connected to one end of the flexible cord 37 will be buoyed up to the level shown by the imaginary lines in FIG. 1, whereby the switch is turned on to allow the motor 3 to be energized. The impeller 15 will then be driven for rotation, thereby causing water to be drawn into the suction chamber 19 through the slits 21 in the strainer 20. After being drawn into the impeller 15 through the suction port 18 of the pump casing 17, a centrifugal force is imparted by the impeller 15 and the water is discharged into the volute-shaped pressure chamber 16 under a swirling motion. The swirling water thrown into the volute-shaped pressure chamber 16 will flow, through a circular opening 10*a* formed in the support plate 10, into an annular flow path 48 between the discharge casing 1 and the motor case 2, where the water swirls thus cooling the periphery of the motor 3 and is then discharged to the outside through a discharge mouth 29, which is formed in the discharge casing 1, and through the discharge pipe 30. As the water surface is lowered by the pumping, the float switch 38 will lower to the position shown by solid lines in FIG. 1, where it is turned off to de-energize the motor 3 thereby stopping the pumping.

Just under the above-mentioned opening 10*a*, a discharge guide plate 49 is fixed in a manner in which it extends between the support plate 10 and the pump casing 17. This discharge guide plate 49 is curved and has a lower end curved toward the viewer's side in FIG. 2 and fixed to the upper surface of the bottom of the pump casing 17. The discharge guide plate 49 serves to guide the swirling water from the pressure chamber 16 to the opening 10*a*, whereby the swirling water can easily flow into the opening 10*a*.

Figure 4A:
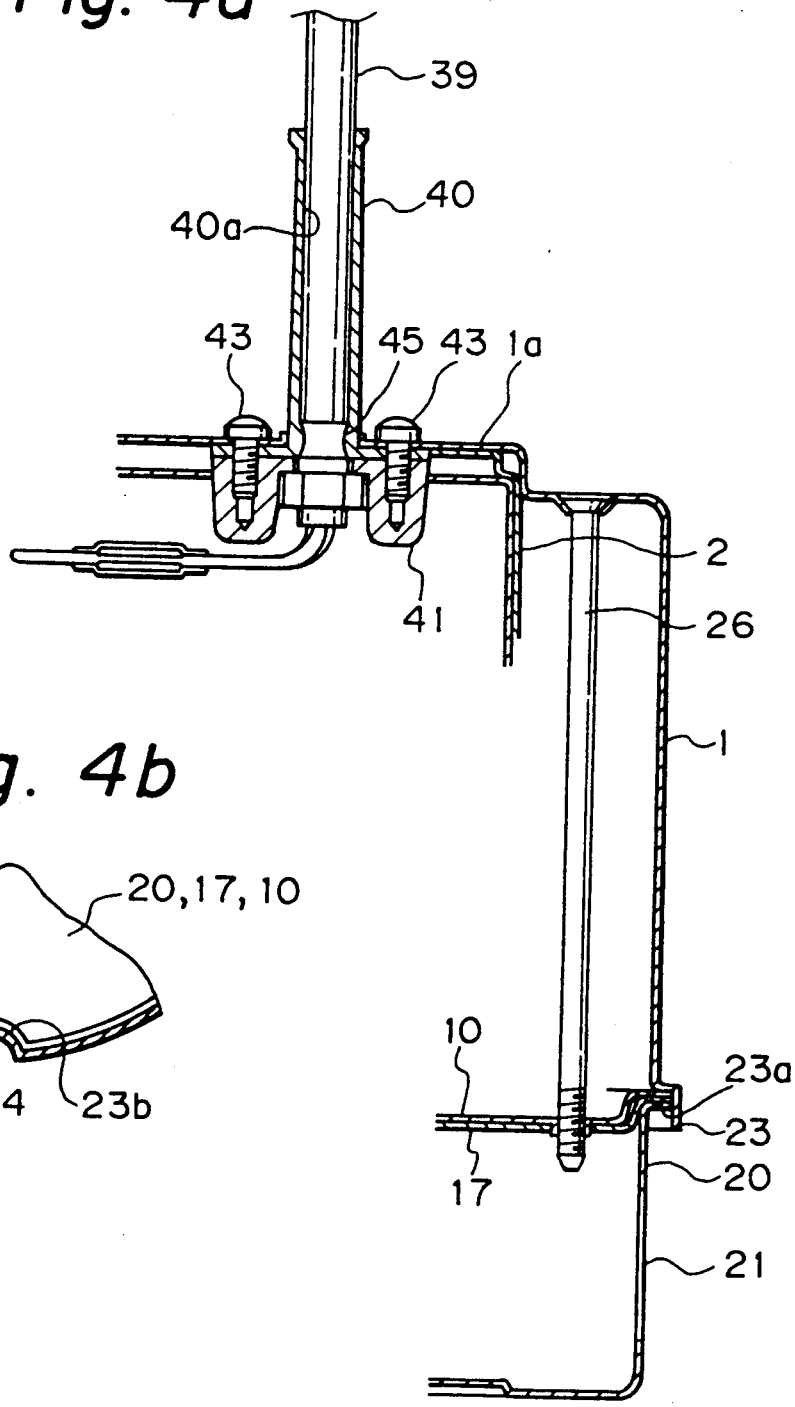
FIG. 4*a* is a sectional view showing a supporting structure for a power supply cord of the first embodiment.
Figure 4B:
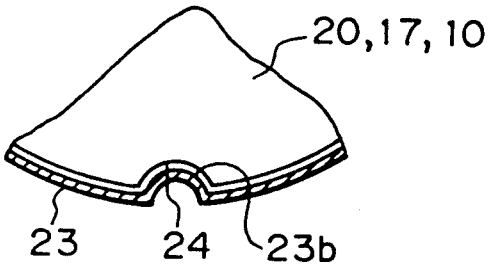
FIG. 4*b* is a fragmentary sectional view taken along line IV—IV in FIG. 2.

A power supply cord 39 for the motor 3 extends out of the discharge casing 1 through the top plate 1*a* of the discharge casing 1 (see FIG. 4*a*). A holder 40, which is formed by molding hard rubber, is fitted in this top plate 1*a*. A plastic receptacle member 41 is provided on the underside of this holder 40. The top plate 1*a* and the receptacle member 41 are fastened together by means of screws 43 with the holder interposed between the top plate 1*a* and the receptacle member 41. The holder 40 has a through hole 40*a* formed therethrough for insertion therethrough of the power supply cord 39. An inwardly projecting projection 45 is formed on a midway portion of the through hole 40*a*. In this arrangement, the upper surface of the lower portion of the holder 40 and the lower surface of top plate 1*a* may be kept in close contact with each other and the projection 45 on the holder 40 presses the periphery of the power supply cord 39, whereby it is ensured that water from outside will not penetrate into the discharge casing 1 or further into the motor case 2, so that electric leakage can surely be avoided.

Figure 5:
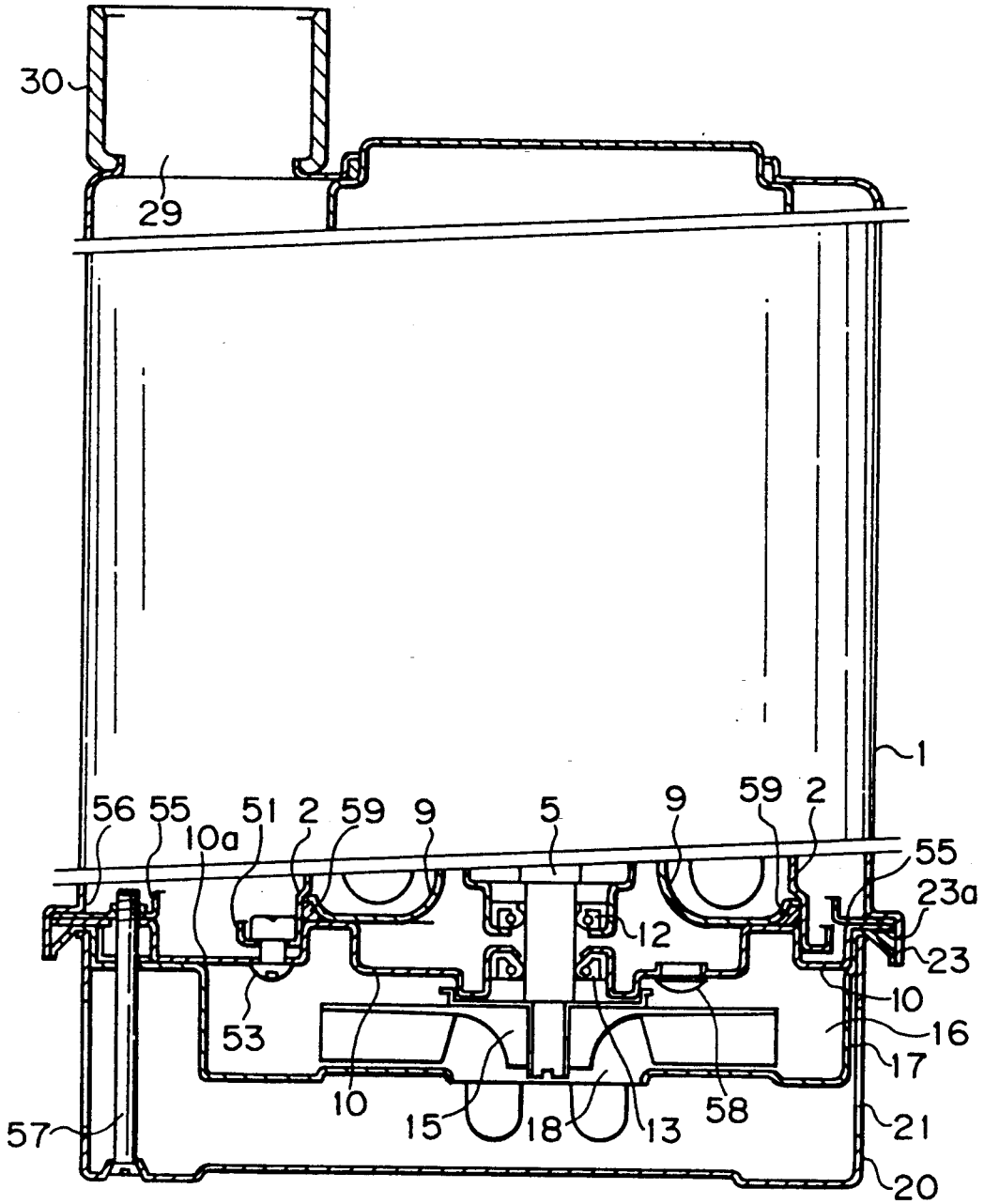
FIG. 5 is a fragmentary longitudinal sectional view of a second embodiment according to the present invention.

FIG. 5 shows another embodiment of the invention.

In this embodiment, a motor case 2 has an outwardly bent connection flange 51 formed integral therewith along the lowermost peripheral edge portion thereof. A support plate 10 is secured to the connection flange 51 by means of a plurality of third bolts 53. A ring-shaped partition plate 55 is beforehand secured to a stepped portion 23*a* of a stepped flange 23 on a discharge casing 1 by spot weldings 56. The above-mentioned support plate 10 secured to the motor case 2, a pump casing 17 and a strainer 20 are secured to the partition plate 55 by means of a plurality of fourth bolts 57.

Figure 6:
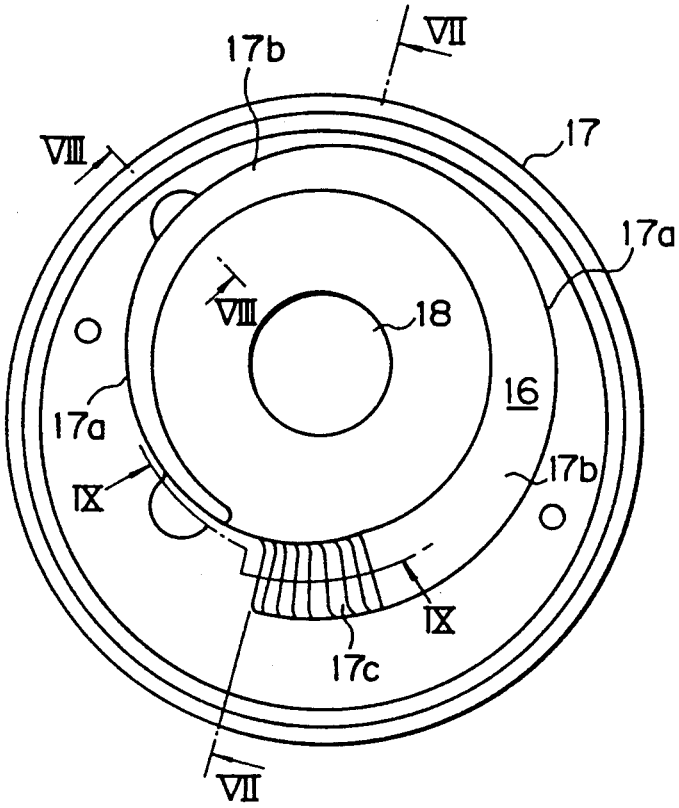
FIG. 6 is a plan view showing a pump casing of the second embodiment.
Figure 7:
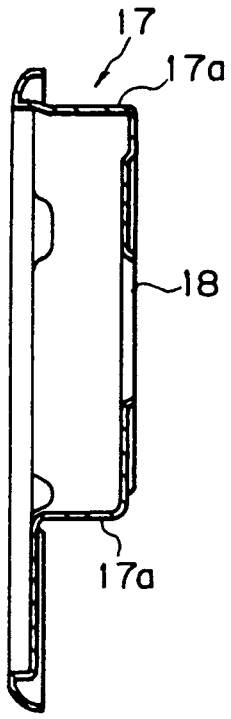
FIG. 7 is a sectional view taken along line VII—VII shown in FIG. 6.
Figure 8:
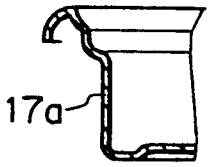
FIG. 8 is a sectional view taken along line VIII—VIII shown in FIG. 6.
Figure 9:
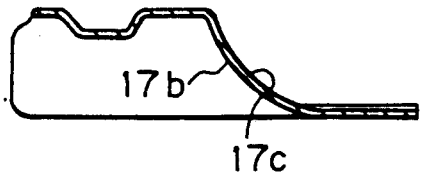
FIG. 9 is a sectional view taken along line IX—IX shown in FIG. 6.

The pump casing 17 has a volute-shaped pressure chamber 16 as shown in FIG. 6. The pressure chamber 16 is defined by a casing shell 17*a* of the pump casing 17, as clearly shown in FIGS. 7 and 8. At the end of the pressure chamber 16, the bottom of the casing shell 17*a* is bent upwardly to form a curved bottom 17*b* which forms a discharge guide surface 17*c* for guiding swirling water. In this embodiment, the swirling water in the pressure chamber 16 is guided along the discharge guide plate 17*c* to an opening 10*a* of the support plate 10. Reference numeral 58 designates a drain plug. The arrangement of this embodiment is otherwise substantially identical to the first embodiment shown in FIG. 2.

The process of assembling this submersible pump is as follows: Firstly, a bearing supporting plate 9 is mounted on the underside of the motor case 2 with an O-ring 59 interposed between them, and then the support plate 10 is placed thereon. The support plate 10 and the connection flange 51 are then screwed together by means of third bolts 53. Subsequently, the peripheries of the above-mentioned support plate 10, the pump casing 17 and the strainer 20 are sequentially mounted in the stepped portion 23*a* of the stepped flange 23.

Since the partition plate 55 is secured to the stepped portion 23*a*, the above-mentioned support plate 10, the pump casing 17 and the strainer 20 are screwed to the partition plate 55 by means of fourth bolts 57. In accordance with this arrangement, the pump may be easily assembled by fastening the third bolts 53 and the fourth bolts 57.

Since, in this embodiment, the third bolts 53 are greatly reduced in length as compared to the first bolts 26 used in the first embodiment, the pump can be assembled still more easily.

If bolts are long and the length from the bolt insertion section of an upper portion of the discharge casing 1 to the threaded holes in the support plate 10 is also long, as shown in FIG. 2, then assembling the pump becomes slightly difficult. In this embodiment, however, such a difficulty caused by excessive bolt length is completely overcome since the third bolts 53 are extremely short.

Further, since the motor case 2 and the support plate 10 are secured together by means of the third bolts 53, it is possible to assemble the motor 3 and test the operation of such motor before the assembling of the entire pump.

From the foregoing, it is clear that, in accordance with the present invention, a submersible pump has a simple structure and the entire pump can be assembled easily.

What is claimed is:

1. A submersible pump comprising: a discharge casing open at the bottom thereof; a motor case fixed inside the discharge casing and containing therein a motor for driving an impeller; a support plate positioned so as to close an opening of said discharge casing for supporting said motor case; a downwardly concaved pump casing placed under the support plate for defining a pressure chamber between it and the support plate; and a downwardly concaved strainer placed under the pump casing for defining a suction chamber between it and the pump casing, said submersible pump being characterized in that said discharge casing has a stepped flange with an outwardly extending portion and a downwardly extending portion which is integrally formed along the periphery of the opening of said discharge casing, in that within a stepped portion of said stepped flange there are sequentially mounted respective peripheral portions of said support plate, of said pump casing, and of said strainer, in that said discharge casing and said support plate are fastened together by first bolts vertically extending therethrough, and in that said support plate, said pump casing and said strainer are fastened together by second bolts vertically extending therethrough.

2. A submersible pump as claimed in claim 1, wherein an annular flow path is defined between said discharge casing and said motor case and said first bolts extend vertically through said annular flow path.

3. A submersible pump as claimed in claim 1 or 2, wherein an annular space is defined between said pump casing and said strainer and said second bolts extend vertically through said annular space.

4. A submersible pump as claimed in claim 1 or 2, wherein a radially inwardly extending projection is formed on the inner surface of said stepped flange, and a groove for receiving said projection therein is formed on the peripheral portion of each of said support plate, said pump casing and said strainer.

5. A submersible pump as claimed in claim 2, wherein said support plate includes an opening communicated with said annular flow path, a curved discharge guide plate is fixed between said support plate and said pump casing so as to guide a water from said pressure chamber to said annular flow path through said opening in said support plate.

6. A submersible pump comprising: a discharge casing open at the bottom thereof; a motor case fixed inside the discharge casing and containing therein a motor for driving an impeller; a support plate positioned so as to close an opening of said discharge casing for supporting said motor case; a downwardly concaved pump casing placed under the support plate for defining a pressure chamber between it and the support plate; and a downwardly concaved strainer placed under the pump casing for defining a suction chamber between it and the pump casing, said submersible pump being characterized in that said motor case has an outwardly extending connection flange formed integral therewith along the lowermost peripheral portion thereof, said connection flange and said support plate are fastened together by third bolts vertically extending therethrough, in that said discharge casing has a stepped flange with an outwardly extending portion and a downwardly extending portion which is integrally formed along the periphery of an opening thereof, in that a partition plate is secured to a stepped portion of the stepped flange, in that under the partition plate secured to the stepped portion there are sequentially mounted respective peripheral portions of said support plate, of said pump casing and of said strainer, and in that said partition plate, said support plate, said pump casing and said strainer are fastened together by fourth bolts vertically extending therethrough.

7. A submersible pump as claimed in claim 6, wherein an annular flow path is defined between said discharge casing and said motor case and said third bolts extend vertically through said annular flow path.

8. A submersible pump as claimed in claim 6 or 7, wherein an annular space is defined between said pump casing and said strainer and said fourth bolts extend vertically through said annular space.

9. A submersible pump as claimed in claim 6 or 7, wherein said partition plate is a ring-shaped one which is secured to said stepped portion by welding.

10. A submersible pump as claimed in claim 7, wherein said support plate includes an opening communicated with said annular flow path, the bottom of said pump casing is bent upwardly to form a discharge guide surface at the end of said pressure chamber, said discharge guide surface guides a water from said pressure chamber into said annular flow path through said opening in said support plate.

11. A submersible pump as claimed in claim 6 or 7, wherein a radially inwardly extending projection is formed on the inner surface of said stepped flange, and a groove for receiving said projection therein is formed on the peripheral portion of each of said support plate, said pump casing and said strainer.

* * * * *